US006318665B1

(12) United States Patent
King

(10) Patent No.: US 6,318,665 B1
(45) **Date of Patent: *Nov. 20, 2001**

(54) VARIABLE SPEED RETRACTABLE REELING DEVICE

(76) Inventor: William King, 45 Mackle Road, East Bentleigh, Victoria, 3165 (AU)

( * ) Notice: Subject to any disclaimer, the term of this patent is extended or adjusted under 35 U.S.C. 154(b) by 0 days.

This patent is subject to a terminal disclaimer.

(21) Appl. No.: 09/520,884

(22) Filed: Apr. 5, 2000

(51) Int. Cl.[7] ..... B65H 75/30
(52) U.S. Cl. ..... 242/385.1
(58) Field of Search ..... 242/385.1, 385.2, 242/385.4

(56) References Cited

U.S. PATENT DOCUMENTS 3,596,849 * 8/1971 Tamarin ..... 242/385.1
3,848,827 * 11/1974 Tamarin ..... 242/385.1
4,227,661 10/1980 King et al. .
4,487,380 12/1984 King .
4,511,101 4/1985 King .
4,854,522 * 8/1989 Brown et al. ..... 242/385.2
5,632,453 * 5/1997 Hioki et al. ..... 242/385.1
5,769,349 * 6/1998 Grosselin ..... 242/385.1

FOREIGN PATENT DOCUMENTS

1198641 * 8/1965 (DE) ..... 242/385.1

* cited by examiner

*Primary Examiner*—Emmanuel M. Marcelo

(57) ABSTRACT

A self re-coiling reeling assembly (1) has a pawl (12), which co-acts with a slotted cam plate (16, 17) and a sliding cam plate. The pawl (12) can arrest the re-reeling action by engagement in a slot (18, 19) in the slotted cam plate. Movement of a sliding cam plate (21) adjusts the lengths of the slots (18, 19). This adjustment determines the re-coil speed at which latching takes place. This adjustment can also prevent latching.

14 Claims, 7 Drawing Sheets

VARIABLE SPEED RETRACTABLE REELING DEVICE

FIELD OF THE INVENTION

This invention relates to a novel adjustable latching device for use with spring tensioned self-recoiling reeling assemblies. In particular, the invention relates to an adjustable latching device for use with spring energised recoiling reelers which are used to recoil linear extendable members such as hoses, cables and the like and which latching devices can automatically latch a linear member so as to hold the member at any desired length.

BACKGROUND TO THE INVENTION

Recoiling reeling assemblies have an elongated element which is normally stored on a drum wheel. These recoiling reeling assemblies have a spring loaded mechanism for rewinding the elongated element onto the drum wheel after that element has been unwound.

For example, domestic garden hoses and electrical cords may be stored in this way, and are arranged to automatically tension a spring as they are unwound. The energy which is thus stored in the spring rewinds the elements onto the reel when the element is released.

These known reeling assemblies include a latching device which operates to retain the elongated element at a particular degree of extension which is chosen by the user.

In order to latch the elongated element when it has been unwound to the required degree of extension, the user slows the rate of unwinding and the device latches. To rewind the elongated element, the user applies sufficient tension to the elongated element to slightly unwind it and thus overcome the latching, and the spring-loaded mechanism rewinds the element back onto the drum. If the user wants to re-latch the elongated element at another position, the user slows the rate of rewinding by manually applying tension to the elongated element, and the latch device operates to again latch the elongated element at the desired extension.

At various elongated elements such as hoses, cables and ropes will require different rates of re-winding, the present invention aims to provide a suitable recoil rotation rate at which the latching device will operate.

It is a subsidiary aim of the present invention to provide a latch device which may be disabled by the user so that it does not operate regardless of how low the rewind speed is.

SUMMARY OF THE INVENTION

The present invention accordingly provides an adjustable latching device for use with a spring actuated self-recoiling reeling assembly, which latching device includes

- a reeler drum rim;
- a reeler casing central disk;
- a slotted cam plate, which cam plate provides at least one latching slot; and wherein the length of each slot can be varied, and
- at least one latching pawl, which is pivotally mounted to the reeler drum and which is adapted to abut with the slot in the cam plate.

PREFERRED ASPECTS OF THE INVENTION

It is preferred that the latching pawl is pivotally mounted to a recess in the reeler drum so that centrifugal force generated by rotation of the reeler drum holds the latching pawl clear of the surface of the cam plate.

Preferably the slotted cam plate is circular. When the slotted cam plate is circular, it is preferred that the cam plate is provided with two latching slots which are displaced from each other along the circumference of the cam plate by substantially 90°.

It is preferred that the device further include a sliding cam plate which can move relative to the slotted cam plate to vary the length of each slot in the slotted cam plate.

It is preferred that the slotted cam plate is moveable to a preset position prior to any reeling or unreeling action. It is further preferred that the sliding cam plate is moveable relative to the slotted cam plate during any reeling or unreeling action.

Preferably the sliding cam plate is moveable to cover the latching slots to over-ride the latching function.

Preferably the sliding cam plate is moveable by movement of an actuator which is external to the reeling assembly. A particularly preferred form of actuator is a thumb press button.

Preferably the sliding cam plate and the reeler casing central disk each carry a series of interlocking serrations.

Preferably each latching pawl is provided with a counter balance configuration beyond the pivot point. This balance can be varied by adding slugged weight where a particular type of linear extendable member being used requires further variation to a desired latching sensitivity.

Preferably the adjustable latching device is constructed of engineering grade moulded plastic parts.

A specific embodiment of the present invention is described below with reference to the accompanying drawings.

DETAILED DESCRIPTION WITH RESPECT TO THE DRAWINGS

Figure 1:
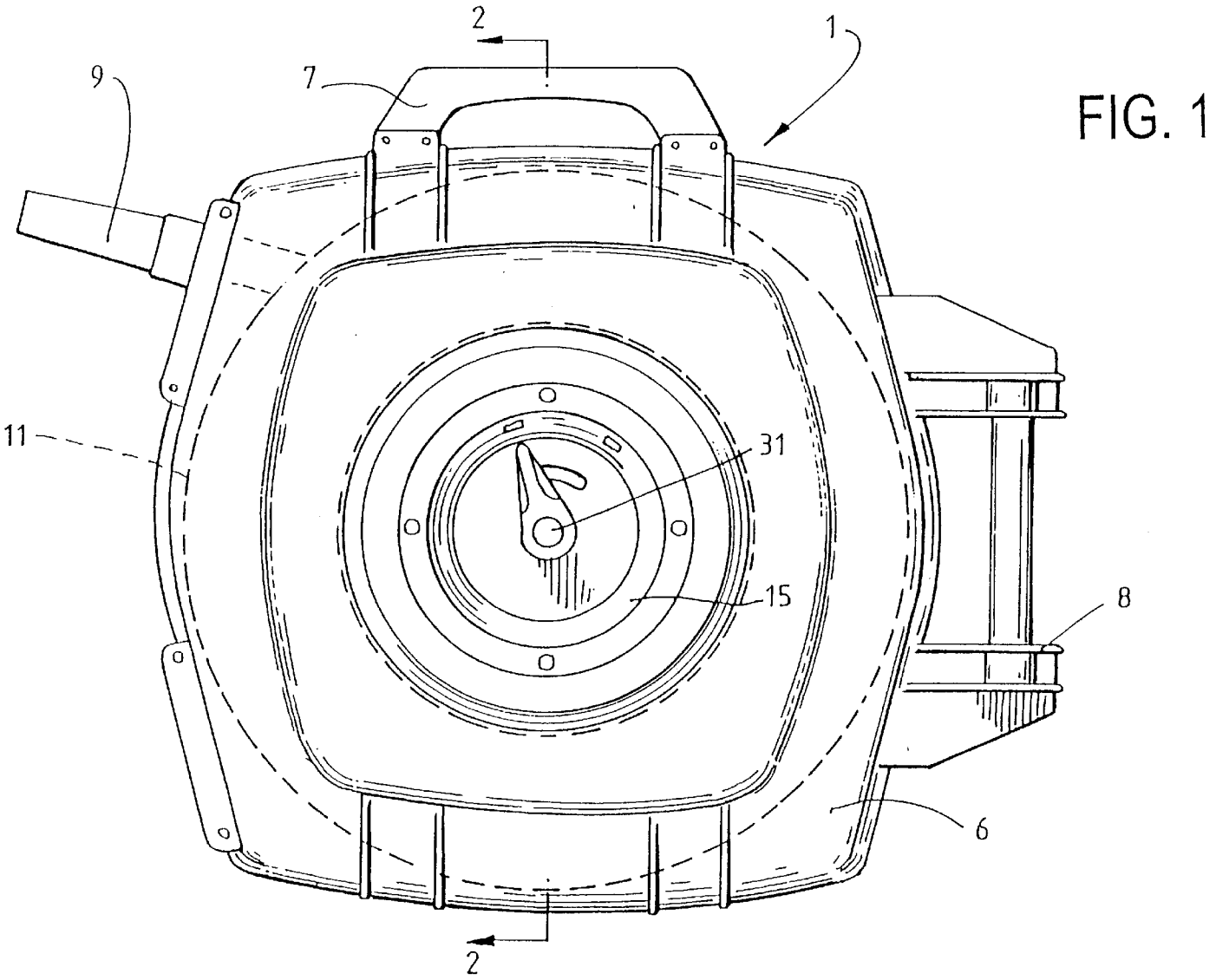
FIG. 1 is a side elevational view of a reeling assembly which incorporates a latching device according to the present invention.

FIG. 1 illustrates a spring tensioned self-recoiling apparatus 1 which incorporates a latching device according to the present invention. The self-recoiling reeling apparatus 1 has a housing 6 which carries two structures 7 and 8 which are displaced from each other by 90□ around a central axis of the housing 6.

The structure 7 can serve as a handle for carrying the apparatus 1, or can provide a mounting for mounting the apparatus 1 with a vertical axis of the mounting passing through the structure 7.

The structure 8 can provide a mounting for mounting the apparatus 1 with a horizontal axis of the mounting passing through the structure 8.

According to the present embodiment of the invention, it is used in conjunction with a hose 9 which is shown protruding from the housing 1.

Figure 2:
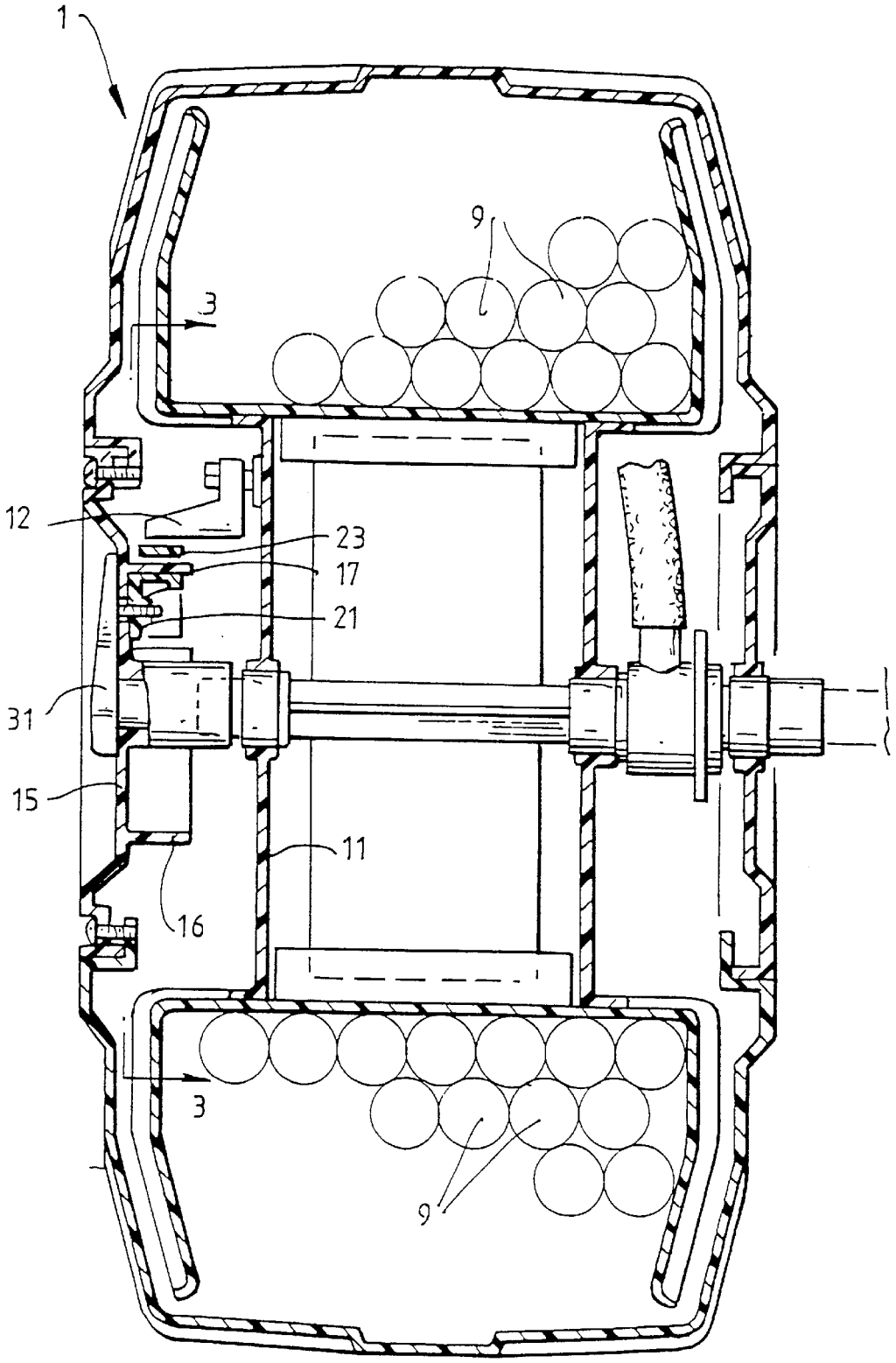
FIG. 2 is a cross-sectional view on the line 2—2 of FIG. 1.
Figure 2A:
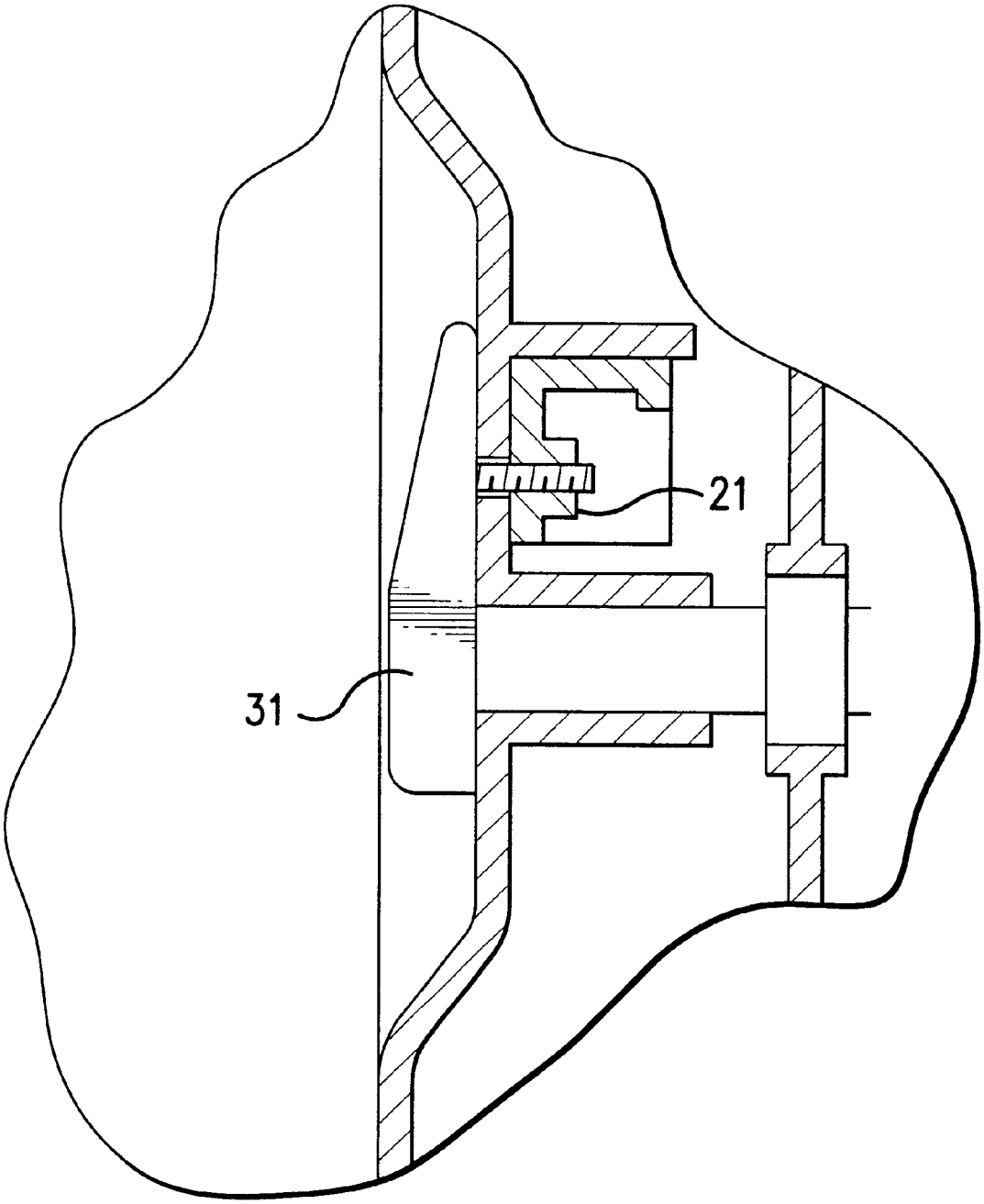
FIG. 2A is an enlarged cutaway view of a portion of FIG. 2.

The cross-sectional view of the apparatus 1 which appears in FIG. 2 shows the hose 9 as wound onto a reeler drum 11.

Figure 3:
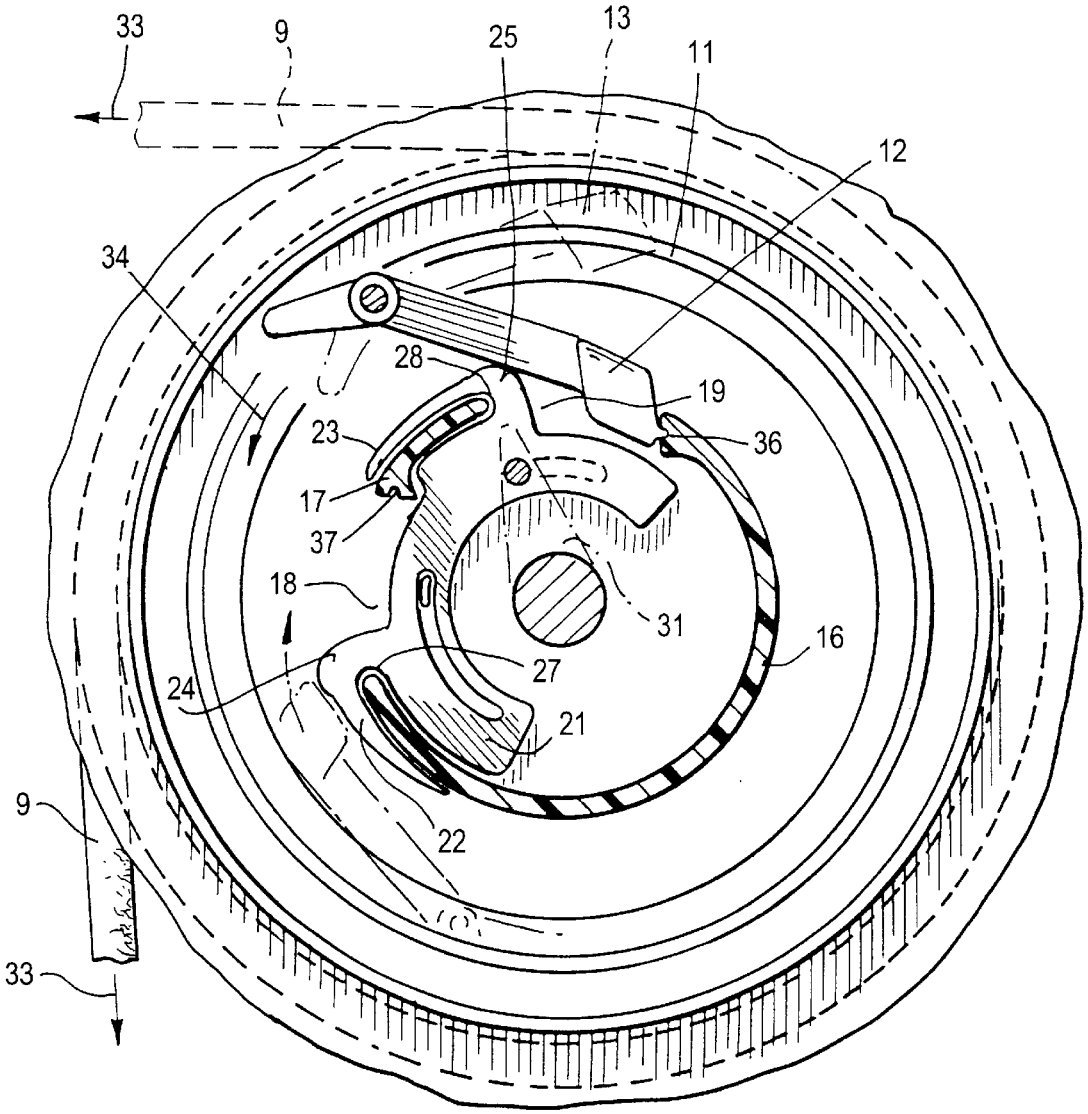
FIG. 3 is an elevational view of interior detail of the reeling assembly looking in the direction of arrow 3 of FIG. 2 when the components of the latching device are in one configuration.

As also shown in FIGS. 2 and 3, a latching pawl 12 is pivotally mounted on the reeler drum 11.

As shown in FIG. 3, a slotted cam plate, or ratchet, which includes arcuate portions 16 and 17 is mounted on the reeler drum central disk 15. The arcuate portions 16 and 17 are spaced radially from the axis of the disk 15. The arcuate portions 16 and 17 define slots 18 and 19 between them.

A slidable cam plate 21 is slidably mounted on the reeler disk 15 for sliding movement about the axis of the disk 15.

The sliding cam plate 21 carries two arm portions 22, 23 which are each attached to the plate 21 by a shoulder portion 24, 25. The arm portions 22, 23 and the shoulder portions 24, 25 form generally U-shaped protrusions from the sliding cam plate 21 which are displaced from each other by substantially 90° about the central axis of the disk 15. The U-shaped protrusions define recesses 27 and 28 for respectively receiving the arcuate portions 16 and 17. The 90° positioning allows the apparatus 1 to be oriented so that the hose 9 can be pulled out vertically or horizontally as is shown in solid and dashed lines in FIGS. 3, 4 and 5.

The sliding cam plate 21 is connected to a central knob 31 which is mounted to the exterior of the housing 1. Movement of the central knob 31 between its extremes of travel moves the sliding cam plate 21 between the positions shown in FIGS. 3 and 4. When the sliding cam plate 21 is in the position shown in FIG. 3, the slots 18 and 19 are operative. When the sliding cam plate 21 is in the position shown in FIG. 4, the slots 18 and 19 are occluded by the arm portions 22 and 23 of the sliding cam plate.

Operation of the latching mechanism is illustrated in FIGS. 2 and 3.

In FIG. 3, the arrow 3 shows the direction of unreeling of the hose 9 from the apparatus 1. As the hose 9 unreels, the reeler drum 11 rotates in the direction of the arrow 34, which is anti-clockwise in this drawing.

When the hose 9 is unreeling sufficiently rapidly, the latch pawl 12, with a counter balance 12*a*, will be carried by the reeler drum 11 at the extreme outermost position which is shown in dotted outline at 13. The counter balance 12*a* can be varied by adding a slug weight 12*b*.

When the hose 9 is sufficiently slowly re-reeling, the latch pawl 12 will, under the influence of gravity, be in contact with the camming surfaces of the slotted cam plate and the sliding cam plate. As the reeler drum 11 rotates into the position shown in FIG. 3 relative to the central disk 15, the latch pawl 12 will be in the position shown where it bears against a leading edge 36 of the cam plate segment 16 and movement of the reeler drum 11 is arrested.

At higher speeds of relative rotation, the latch pawl 12 will receive an impetus from the shoulder portion 25 of the sliding latch plate 21. Depending on the magnitude of this impetus, the rate of relative rotation, and the length of the slot 19 which has not been occluded by the sliding latch plate 21, the latch pawl 12 may or may not bear against the leading edge 36 of the cam plate segment 16 to arrest relative movement.

Figure 4:
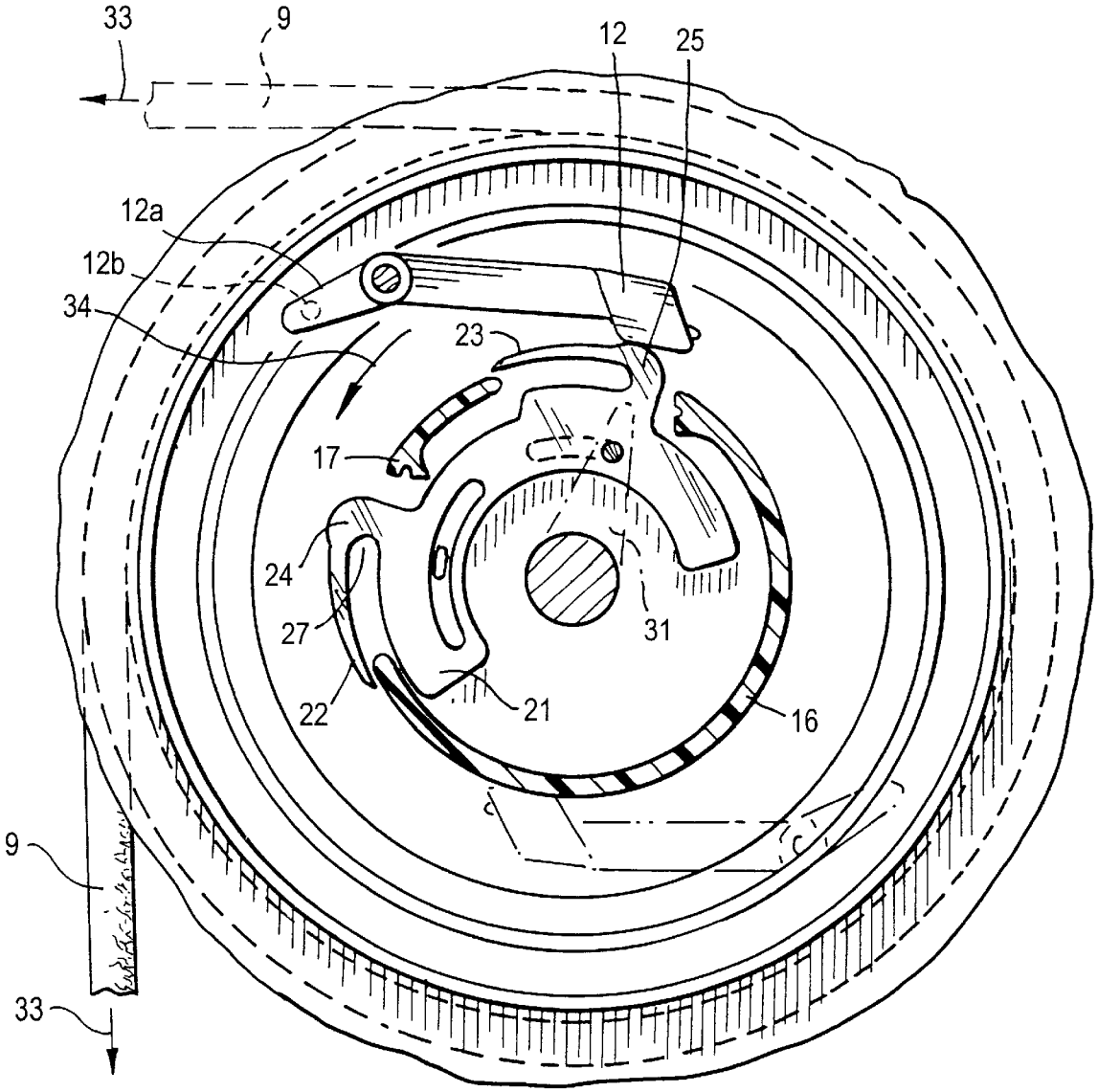
FIG. 4 is a view similar to FIG. 3, when the components of the latching device are in another configuration.

The relative positions of the slotted cam plate 16, 17 and the sliding cam plate 21 are shown at one extreme in FIG. 4. In this extreme position the arm portions 22 and 23 of the sliding cam plate 21 completely occlude the slots 18 and 19 of the slotted cam plate, and the latch pawl 12 cannot come into contact with the leading edge 36 to arrest the re-reeling action.

Figure 5:
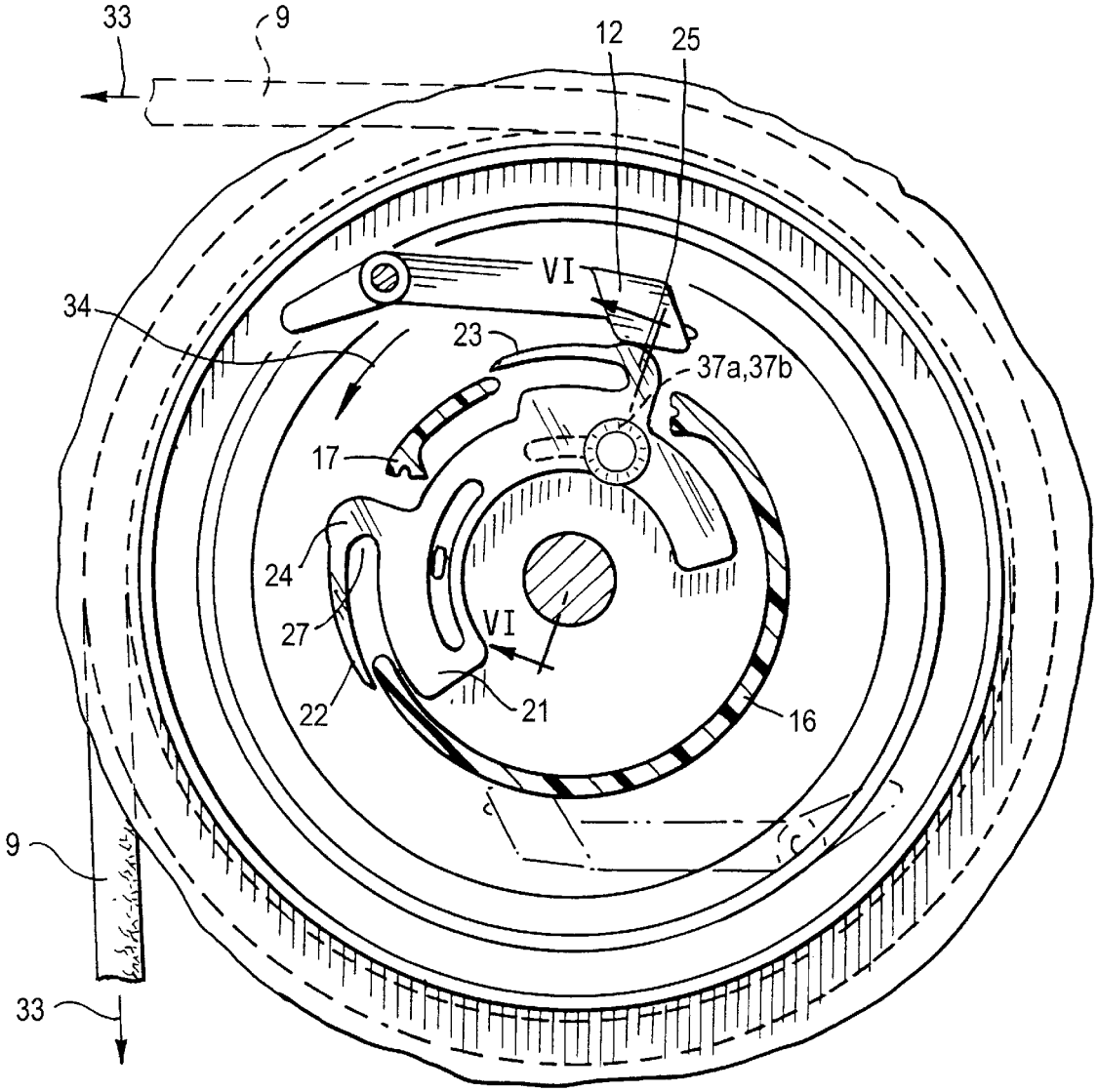
FIG. 5 is a view similar to FIG. 4, but showing a modified embodiment.
Figure 6:
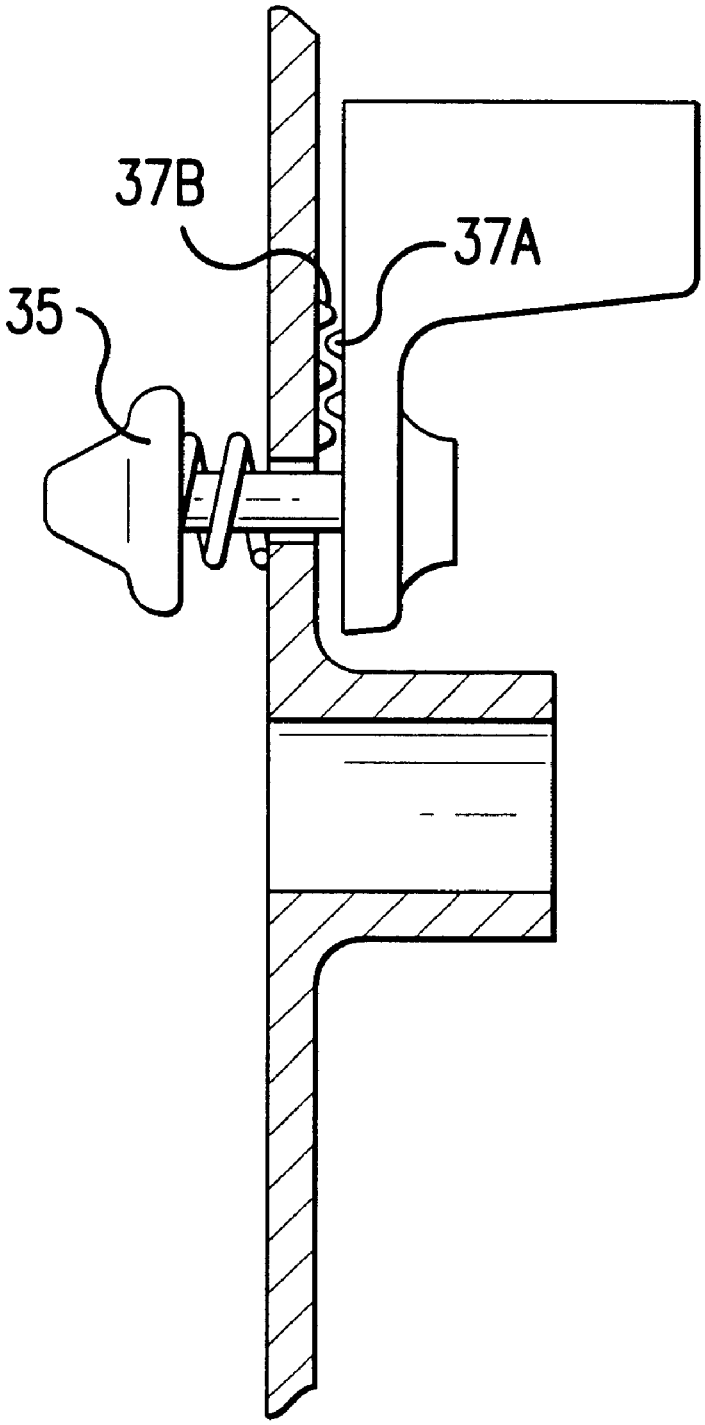
FIG. 6 is a cross-sectional view taken on line VI—VI in FIG. 5.

A modified embodiment is depicted in FIGS. 5 and 6 in which the central knob 31 is replaced by a thumb press button 35, with the sliding cam plate and the reeling casing central disk each carrying a series of interlocking serrations 37*a* and *b*.

I claim:

1. An adjustable latching device for use with a spring actuated self-recoiling reeling assembly, said latching device including:

a rotatable reeler drum;

a reeler casing located adjacent said rotatable reeler drum, with said rotatable reeler drum being rotatable relative to the reeler casing;

a slotted cam plate supported by said reeler casing, which cam plate:

provides at least one latching slot, with the length of said at least one latching slot being selectively variable, and at least one latching pawl, which is pivotally mounted to the reeler drum and which is adapted to enter into the latching slot in the cam plate and thereby arrest rotatable movement of the reeler drum relative to the reeler disk;

wherein the length of the slot can be selectively varied to determine the ease with which the latching pawl can arrest rotatable movement of the reeler drum relative to the reeler disk.

2. The adjustable latching device as claimed in claim 1, in which the latching pawl is pivotally mounted at a recess in the reeler drum so that centrifugal force generated by rotation of the reeler drum holds the latching pawl clear of the surface of the cam plate.

3. The adjustable latching device as claimed in claim 1 in which the slotted cam plate is circular.

4. The adjustable latching device as claimed in claim 3 in which the slotted cam plate is provided with two latching slots, which are displaced from each other along the circumference of the cam plate by substantially 90°.

5. The adjustable latching device as claimed in claim 1, wherein said cam plate includes two plate members which can move relative to each other to vary the length of said at least one slot in the slotted cam plate.

6. The adjustable latching device as claimed in claim 1 in which the slotted cam plate includes two plate members, one fixed relative to the casing and the other moveable relative to the casing to be positioned prior to any reeling or unreeling action for selectively varying the length of the slot.

7. The adjustable latching device as claimed in claim 6 in which the plate members are moveable relative to one another during any reeling or unreeling action.

8. The adjustable latching device as claimed in claim 1 in which the slotted cam plate comprises a stationary slotted plate member, and a sliding plate member being relatively moveable to sufficiently reduce the length of the at least one latching slot to over-ride the latching function.

9. The adjustable latching device as claimed in claim 1 in which the slotted cam plate comprises two plate members that are moved relative to one another by movement of an actuator, which is external to the reeling assembly.

10. The adjustable latching device as claimed in claim 9 in which the actuator is a thumb press button.

11. The adjustable latching device as claimed in claim 1 in which the slotted cam plate and the reeling casing each carry a series of interlocking serrations.

12. The adjustable latching device as claimed in claim 1 in which the at least one latching pawl is provided with a counter balance configuration beyond a pivot point from that portion of the latching pawl that enters into the latching slot.

13. The adjustable latching device as claimed in claim 12 in which a balance of said at least one latching pawl can be varied by adding slugged weight.

14. The adjustable latching device as claimed in claim 1, wherein parts thereof are constructed as engineering grade moulded plastic parts.

* * * * *

UNITED STATES PATENT AND TRADEMARK OFFICE

CERTIFICATE OF CORRECTION

PATENT NO. : 6,318,665 B1
DATED : November 20, 2001
INVENTOR(S) : William King

It is certified that error appears in the above-identified patent and that said Letters Patent is hereby corrected as shown below:

Title page,
Item [*] Notice, please remove the "Notice: This patent is subject to a terminal disclaimer."

Signed and Sealed this

Second Day of July, 2002

*Attest:*

*Attesting Officer*

JAMES E. ROGAN
*Director of the United States Patent and Trademark Office*